United States Patent [19]

Shaw

[11] Patent Number: 4,759,155

[45] Date of Patent: Jul. 26, 1988

[54] PARTICLE COLLECTING SANDER

[76] Inventor: Christopher J. Shaw, 508 Washington St., Royersford, Pa. 19468

[21] Appl. No.: 22,715

[22] Filed: Mar. 6, 1987

[51] Int. Cl.[4] ..... B24D 15/02

[52] U.S. Cl. ..... 51/392; 51/273; 51/180; 15/231; 15/396

[58] Field of Search ..... 51/170 TL, 170 MT, 180, 51/273, 358, 362, 391, 392, 393; 15/231, 396

[56] References Cited

U.S. PATENT DOCUMENTS

| | | | |
|---|---|---|---|
| 2,499,933 | 3/1950 | Smul | 51/362 X |
| 3,638,362 | 2/1972 | Stoll | 51/170 MT |
| 3,826,045 | 7/1974 | Champayne | 51/273 X |
| 3,932,966 | 1/1976 | Stern | 51/170 MT X |
| 4,062,152 | 12/1977 | Mehrer | 51/273 X |
| 4,158,935 | 6/1979 | Robert | 51/273 X |
| 4,549,371 | 10/1985 | Hakoda | 51/273 X |

FOREIGN PATENT DOCUMENTS 3413028 10/1985 Fed. Rep. of Germany ..... 51/273

*Primary Examiner*—Robert P. Olszewski
*Attorney, Agent, or Firm*—John P. Donohue, Jr.

[57] ABSTRACT

An apparatus for sanding and collecting sanded particles. The particle collecting sander includes a base member having a negative pressure chamber contained within. The base is secured to a cover member which is provided with a multiplicity of grooves extending across the outer surface of the cover member. A plurality of ports are provided in the grooves to create a fluid connection between the grooves and the negative pressure chamber. A pourous abrasive material overlays the cover member. In operation a series of negative pressure zones are created across the surface of the pourous abrasive material.

9 Claims, 1 Drawing Sheet

PARTICLE COLLECTING SANDER

BACKGROUND OF THE INVENTION

1. Field of the Invention

This invention relates to the field of sanding tools and more particularly to a particle collecting sander which both removes and collects particles from a sanded surface.

2. Description of Art

For as long as sanding devices have been used to smooth surfaces, there has existed a need to collect the particular matter created as a result of the sanding operation. Traditionaly, sanding/particle collection was done as a two step manual process. In an attempt to combine sanding and collecting into a single operation, various tools were developed.

U.S. Pat. No. 2,499,933—Smul shows a device which combines a vacuum cleaner attachment and a sanding tool wherein the sanding tool is provided with a plurality of openings. The sanding tool is mounted inside the opening of the vacuum cleaner attachment in order that dust and removed material can be carried off by suction through the openings and a gap provided between the outer edges of the sanding tool and the interior edges of the vacuum attachment. U.S. Pat. No. 4,062,152—Mehrer also shows a combination vacuum/-sanding tool where a plurality of openings are provided in a backing plate which is covered by a pourous adhesive sheet. U.S. Pat. No. 4,549,371—Hakoda shows a vacuum/sanding tool wherein the apparatus for creating a negative pressure is mounted within the tool itself. A number of suction passages are provided through a sandpaper engaging layer which passages are alligned with line holes in the sandpaper. Hakoda also provides a number of channels formed in the sandpaper engaging layer to create a number of openings on the outer edges of the layer.

Each of the above described tools suffer from similar problems. Since a negative pressure cannot be created across the surface of the sanding material, particle collection efficiency is minimized. It would appear that collection efficiency could be improved by increasing the negative pressure applied to the various openings. However, as negative pressure is increased, the above tools will have a tendency to stick to the surface being sanded requiring a greater force to move the tool. Increasing the force required to move the sanding tool becomes a significant drawback, especially in manual labor operations. Increasing the force requires a greater effort on the part of the laborer which will inevitably result in a reduced work period.

A further problem comes into play when devices such as U.S. Pat. No. 4,062,152 use pourous abrasive material, namely the clogging of pores in the material with particulate matter. Such clogging reduces significantly the sanding efficiency of the device. One solution to this problem is to replace the material, another is to remove and clean the material. Neither of these solutions presents an acceptable alternative.

A still futher problem associated with collecting/-sanding tools is that it is not economically feasible to reuse the sanded material. For example in a spakle-sanding operation, once dried and sanded spakle particles can be reused. Up to now, however, collection efficiency has not been capable of recovering a sufficient amount of material.

U.S. Pat. No. 3,826,045—Champayne is mentioned only because it shows the use of a hollow handle to apply a negative pressure in a dust collection operation.

SUMMARY OF THE INVENTION

It is therefore an object of the invention to provide a particle collecting sander which maximises the efficiency of collecting particles which at the same time minimizes the manual effort required to use the sander.

It is a further object of the invention to provide a particle collecting sander which utilizes a pourous abrasive material.

It is a further object of the invention to provide a particle collecting sander which prevents pourous abrasive material from becoming clogged during operation.

It is a further object of the invention to provide a particle collecting sander with sufficient collection efficiency to allow reuse of sanded particles.

Still another object of the invention is to provide a particle collecting sander which has a number of grooves formed beneath a pourous abrasive material.

It is still a further object of the invention to provide a particle collecting sander which includes a hollow handle to connect the sander to a negative pressure source.

These and other objects and advantages of the invention will become more apparent from the following detailed description when taken in conjunction with the following drawings.

DETAILED DESCRIPTION OF THE PREFERRED EMBODIMENT

Figure 1:
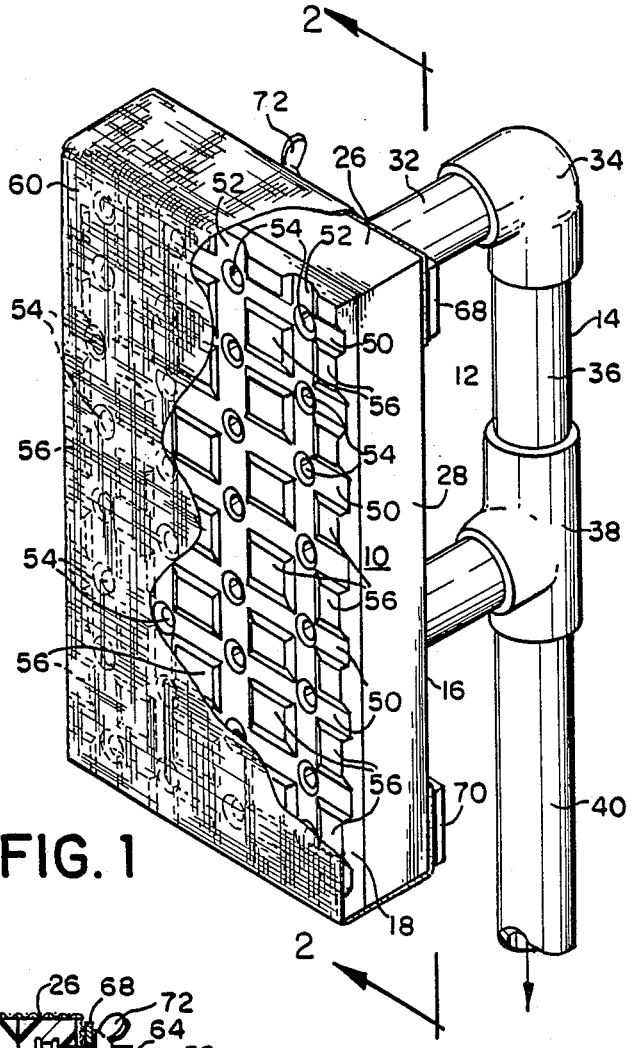
FIG. 1 is a prospective view of a particle collecting sander incorporating the novel features of the present invention.
Figure 3:
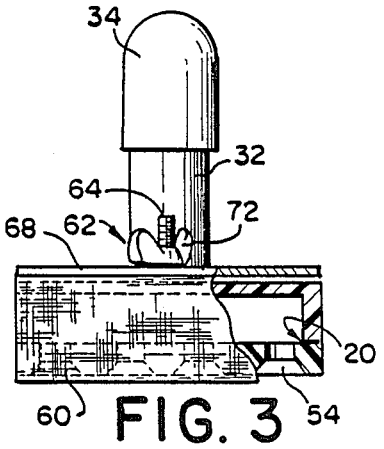
FIG. 3 is a front elevational view, having a partial section view, of the particle collecting sander shown in FIG. 1.

As shown in the drawings for purpose of illustration, the invention is embodied in a novel construction of a particle collecting sander, generally designated 10.

Sander 10 is operated by pressing its pourous abrasive face against a surface where smoothing is desired. A negative pressure created within Sander 10 serves to collect dust another particulate matter, through the pourous face and out through various opening, as sander 10 is moved along the desired surface. As will be appreciated herein the novel structural arrangement of sander 10 maximises particle collecting efficiency while minimizing the effort necessary to use the sander.

Sander 10 is shown to include a body 12 to which a handle is attached. Body 12 is constructed from base 16 and cover 18. In the preferred embodiment, the secure attachment of cover 18 to base 16 achieves a fluid tight seal. Cover 18 overlies chamber opening 20 of chamber 22 formed in base 16. During operation a negative pressure is created within chamber 22 by a fluid connection between chamber 22 and to a negative pressure source (not shown).

Figure 2:
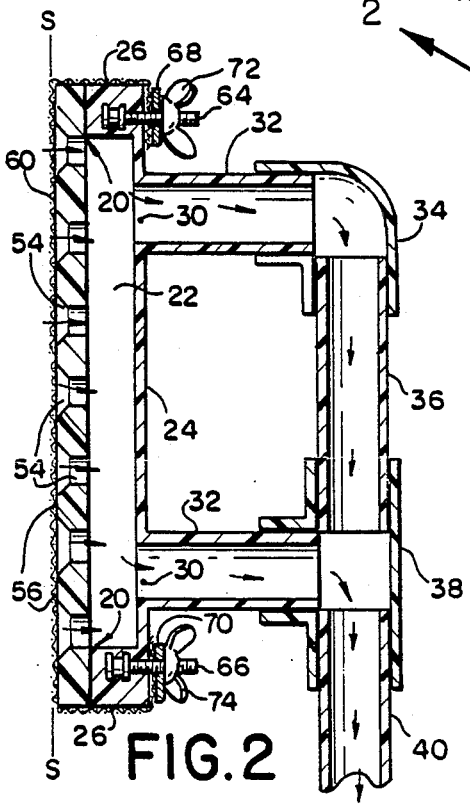
FIG. 2 is a sectional view along the line 2—2 of the particle collecting sander show in FIG. 1.
Figure 4:
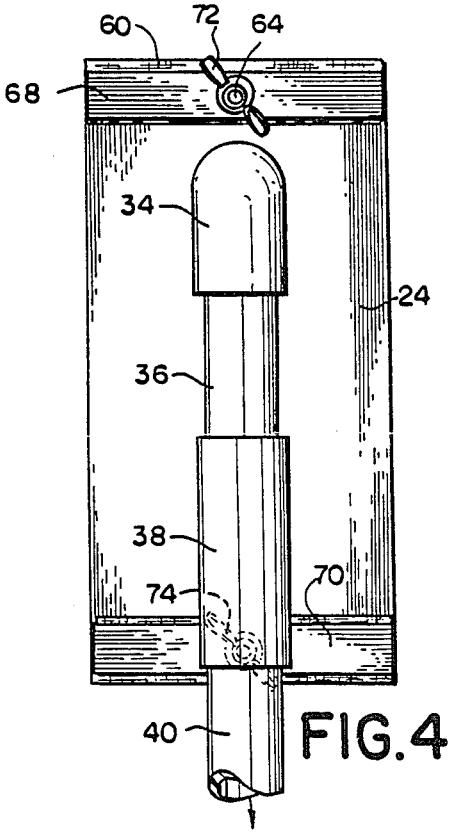
FIG. 4 is a top elevational view of the particle collecting sander shown in FIG. 1.

As shown in FIG. 2, chamber 22 is defined by top member 24, end walls 26 and side walls 28. Top member 24 has two through bores 30 formed therein. Hollow columns 32, 33 project generally perpendicular from member 24 and are positioned to surround bores 30. In the preferred embodiment columns 32, 33 are shown to be integrally formed with member 24. However it is recognized that attachment of columns 32, 33 to member 24 by any means would be acceptable as long as a fluid tight seal was created.

Handle 14, which attaches to columns 32, 33 is shown to include an elbow 34 attached to one end of sleeve 36 and a T-joint 38 attached to the other end of sleeve 36. The remaining open end of elbow 34 and the base of T-joint 38 are e attached to columns 32, 33 respectively. An extension sleeve 40 is attached to the remaining open end of T-joint 38 for connection to a negative pressure source. It will be understood, although not shown, that extension sleeve 40 will be adapted at its open end in any known manner for connection to a hose or other means of establishing a flexible fluid connection between handle 14 and a negative pressure source. It will also be appreciated that the attachment of eact part of handle 14 should be such that a fluid tight seal is created. It may also be desireable to integrally form the entire handle 14 and top member 24.

As can now be appreciated handle 14 serves to establish fluid communication between chamber 22 and a negative pressure source such that a negative pressure can be created within chamber 22.

Turning now to cover member 18, there is defined an outer sanding surface which lies in the plane S—S shown in FIG. 2. A number of horizontal grooves 50 and vertical grooves 52 are formed in member 18. The grooves are alligned to intersect in substantially perpendicular directions. The grooves are shown as generally trapezoidal shaped in cross-section having the base of each trapezoid lie in the plane S—S. Each groove is shown to extend across member 18, terminating in the peripheral side edges thereof. Ports 54 are positioned at the various points of intersection of grooves 50 and 52. Each port 54 passes through member 18 establishing a fluid communication between chamber 22 and grooves 50 and 52. In the preferred embodiement, ports 54 are circular in shape and have a diameter equal to the width of the groove in which it lies.

The formation of intersecting grooves 50 and 52 in member 18 creates a number of plateau-like surfaces 56, each of which also lie in the plane S—S. Surfaces 56 serve to transfer the force excerted during the sanding operation to an abrasive material. In the preferred embodiement a commercially available pourous abrasive material 60 is utilized. Material 60 is positioned to overlie cover member 18, including grooves 50, 52 and ports 54, pressing against surfaces 56 during a sanding operation. Material 60 extends across end walls 26 and is removably attached to base 16 by clamping mechanism 62. Clamping mechanism 62 is shown to include two bolts 64, 66 each of which pass through top member 24 in general proximity to end walls 26. Plates 68 and 70 are mounted over bolts 64 and 66, respectively, serving to clamp material 60 between plates 68 and 70 and top member 24. Clamping force is provided by wing nuts 72 and 74, which are screwed onto bolts 64 and 66, respectively.

Considering now sander 10 in operation, a negative pressure source is connected to handle 14 resulting in the creation of a negative pressure in chamber 22. Creation of a negative pressure in chamber 22 results in a negative pressure within grooves 50 and 52 which in turn results in a negative pressure effectively along the length and width of material 60 overlying cover member 18. Assuming air is utilized as the fluid medium, one can now see that as sander 10 is moved along a surface, material 60 is caused to abrade such surface due to the force transferred from surfaces 56, resulting in the creation of dust and particulate matter. Such dust and sanded particles will be drawn through material 60 and carried by air to the negative pressure source. Since a negative pressure is created along continous paths across the length and width of material 60, and carried by air to negative pressure source. Since a negative pressure is created along continous paths across the length and width of material 60, a minimum of particulate matter will not be collected. By terminating grooves 50 and 52 in the peripheral side edges of cover member 18, those particles not passing through material 60 will nonetheless be collected via the negative air pressure surrounding the side edges of cover member 18.

A further advantage of creating negative pressure zones across the length and width of material 60 is in the prevention of clogging the material's pores with sanded material. Since virtually no particulate matter remains lodged in the material and since the negative pressure zones created around the periphery of cover 18 prevent any uncollected matter from escaping, reuse of sanded particles, for example spakle particles, now becomes possible.

Additionally, I have discovered using the above described sander that increasing the negative pressure to achieve maximum efficency has little or no effect on the force required to move the sander during operation.

As used herein the term spakle is believed to be generic and includes plaster or any type of joint compound used in drywall or wall-board construction.

While the preferred embodiement of the present invention has been described in detail, various modifications, alterations and changes may be made without departing from the spirit and scope of the present invention as defined in the appended claims.

I claim:

1. A particle collecting sander, comprising:

a base having a chamber formed therein and a chamber opening formed therethrough, said base also having a through bore whereby fluid communication can be established between said chamber and a negative pressure source;

a cover member, positioned over said chamber opening, having peripheral edges and one side being defined as a sanding surface;

a pourous abrasive material member overlaying said sanding surface wherein that portion of said material member supported by said sanding surface defines an abrasive face;

securement means for securing said abrasive material member to said base; and negative pressure zone means, formed in said sanding surface and in fluid communication with said chamber, for creating a continuous negative pressure zone extending substantially across said abrasive face so that when said chamber is in fluid communication with a negative pressure source and said abrasive face is moved into contact with a surface to be sanded particles are collected throughout said zone.

2. The sander of claim 1, wherein said negative pressure zone means comprises a multiplicity of grooves formed in and extending across said sanding surface such that the ends of each groove terminate in a separate peripheral edge, with each of said edges containing several of said groove ends, and a plurality of ports located in said grooves, said ports extending through said cover member so that fluid communication exists between said chamber and said grooves.

3. The sander of claim 2, wherein the peripheral edges in which any one of said grooves terminates are located opposite each other.

4. The sander of claim 3, wherein certain of said grooves intersect other of said grooves, and wherein said ports are formed at said intersection.

5. The sander of claim 4, wherein said intersection of said grooves is generally perpendicular.

6. The sander of claim 5 wherein said grooves are generally trapezoidal shaped in cross-section.

7. The sander of claim 2, further comprising a handle, having a passage therethrough wherein one end of said passage terminates at a portion of the handle which is secured in fluid tight engagement with that portion of said base surrounding said through bore such that fluid communication exists between said passage and said chamber and wherein the other end of said passage terminates at a portion of said handle which is adapted for connection to said negative pressure source.

8. The sander of claim 7, wherein said handle is integrally formed with said body.

9. The sander of claim 7, wherein said handle is hollow and wherein said handle attaches to said body at two locations, each location on said body having formed at that point a through bore, further said handle having a connection member for connecting said handle to said negative pressure source, whereby fluid communication can be established between said chamber and said negative pressure source.

* * * * *